US010221751B2

(12) United States Patent
Yang et al.

(10) Patent No.: US 10,221,751 B2
(45) Date of Patent: Mar. 5, 2019

(54) ENGINE COOLING SYSTEM HAVING COOLANT TEMPERATURE SENSOR

(71) Applicant: Hyundai Motor Company, Seoul (KR)

(72) Inventors: Kwang Sik Yang, Gunpo-si (KR); Taewon Park, Ansan-si (KR); Hyun Kyu Lim, Suwon-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 51 days.

(21) Appl. No.: 15/366,680

(22) Filed: Dec. 1, 2016

(65) Prior Publication Data

US 2017/0284278 A1 Oct. 5, 2017

(30) Foreign Application Priority Data

Apr. 1, 2016 (KR) ..... 10-2016-0040399

(51) Int. Cl.
*F01P 7/14* (2006.01)
*F01P 7/16* (2006.01)

(52) U.S. Cl.
CPC ..... *F01P 7/16* (2013.01); *F01P 7/167* (2013.01); *F01P 2007/146* (2013.01);
(Continued)

(58) Field of Classification Search
CPC ..... F01P 7/16; F01P 7/167; F01P 2007/146; F01P 2025/08; F01P 2025/13;
(Continued)

(56) References Cited

U.S. PATENT DOCUMENTS 6,223,700 B1 * 5/2001 Sano ..... F01P 7/167 123/41.02
6,857,398 B2 * 2/2005 Takagi ..... F01P 7/167 123/41.1

(Continued)

FOREIGN PATENT DOCUMENTS

JP 05-231148 A 9/1993
JP 2003-201844 A 7/2003

(Continued)

*Primary Examiner* — Hung Q Nguyen
*Assistant Examiner* — Anthony Donald Taylor, Jr.
(74) *Attorney, Agent, or Firm* — Brinks Gilson & Lione

(57) ABSTRACT

The present disclosure provides an engine cooling system having a coolant temperature sensor to sense the temperature of coolant discharged from an engine; a radiator radiating heat while part of the coolant discharged from the engine is passed through the radiator; a coolant control valve unit to control coolant passing through the radiator and coolant supplied from the engine; and a control unit configured to control the temperature of coolant by controlling the coolant control valve unit according to the coolant temperature sensed by the coolant temperature sensor, wherein the control unit calculates a coolant temperature at an entrance of the engine using the sensed coolant temperature and a heat rejection rate of the engine based on the operation condition, calculates a temperature of coolant discharged from the radiator, and controls the opening degree of the coolant control valve unit using the coolant temperatures.

10 Claims, 13 Drawing Sheets

(52) U.S. Cl.
CPC ..... *F01P 2025/08* (2013.01); *F01P 2025/13* (2013.01); *F01P 2025/30* (2013.01); *F01P 2025/62* (2013.01); *F01P 2025/64* (2013.01); *F01P 2025/66* (2013.01)

(58) Field of Classification Search
CPC ..... F01P 2025/30; F01P 2025/62; F01P 2025/64; F01P 2025/66
USPC ..... 123/41.08
See application file for complete search history.

(56) References Cited

U.S. PATENT DOCUMENTS

| | | | | |
|---|---|---|---|---|
| 2003/0047149 | A1* | 3/2003 | Shinpo | F01P 7/167 123/41.1 |
| 2004/0055283 | A1* | 3/2004 | Iihoshi | F01P 7/164 60/284 |
| 2004/0065275 | A1* | 4/2004 | Hayami | F01P 7/164 123/41.1 |
| 2006/0005790 | A1* | 1/2006 | Braun | F01P 7/167 123/41.08 |
| 2012/0118987 | A1* | 5/2012 | Brenner | F16K 31/002 236/93 R |
| 2016/0230642 | A1* | 8/2016 | Bilancia | F01P 7/167 |
| 2017/0107891 | A1* | 4/2017 | Murai | F01P 7/16 |

FOREIGN PATENT DOCUMENTS

| | | | |
|---|---|---|---|
| JP | 2007-120312 | A | 5/2007 |
| JP | 2008-051073 | A | 3/2008 |
| KR | 10-0361305 | B2 | 11/2002 |
| KR | 10-0521913 | B2 | 10/2005 |

* cited by examiner

FIG. 4A $$\alpha = \frac{Cp2 \times B0 \times T2 - Cp1 \times B0 \times T1}{Cp1 \times T1(A1+B1-B0) - Cp2 \times T2(B1-B0) - Cp3 \times A1 \times T3}$$ --Equation 1 (Cp is temperature function)

FIG. 4B $$\alpha = \frac{B0(T2-T1)}{A1(T1-T3) - (B1-B0)(T2-T1)}$$ --Equation 2 (Cp is treated like constant)

ENGINE COOLING SYSTEM HAVING COOLANT TEMPERATURE SENSOR

CROSS-REFERENCE TO RELATED APPLICATION

This application claims priority to and the benefit of Korean Patent Application No. 10-2016-0040399, filed on Apr. 1, 2016, the entire contents of which are incorporated herein by reference.

FIELD

The present disclosure relates to an engine cooling system having a coolant temperature sensor.

BACKGROUND

The statements in this section merely provide background information related to the present disclosure and may not constitute prior art.

An engine generates torque through the combustion of fuel, and a part of the fuel is exhausted as thermal energy. In particular, coolant absorbs thermal energy while circulating through the engine, a heater and a radiator, and releases the absorbed thermal energy to the outside.

When the coolant temperature of the engine is low, the viscosity of oil may increase while raising friction and fuel consumption. Then, the temperature of exhaust gas may slowly rise to increase the time required for activating a catalyst, and the quality of exhaust gas may be deteriorated. Furthermore, quite a long time may be required until the function of the heater is normalized.

When the coolant temperature of the engine is excessively high, knocking may occur. When ignition timing is adjusted in order to suppress the occurrence of knocking, the performance may be degraded. Furthermore, when the temperature of lubricant is excessively high, lubrication may not be normally performed.

Thus, a coolant control valve unit is applied to control a plurality of cooling elements through one valve. The coolant control valve unit may maintain the temperature of coolant at a high temperature in a specific portion of the engine while maintaining the temperature of coolant at a low temperature in another portion of the engine.

The coolant control valve unit controls coolant which circulates through each of the engine (oil cooler, heater and EGR cooler), the radiator and the like, thereby improving the entire cooling efficiency of the engine and reducing fuel consumption.

Therefore, a coolant temperature sensor is used to sense coolant temperature at a predetermined position, a target coolant temperature is set according to an operation condition, and the coolant control valve unit is controlled according to the target coolant temperature.

In particular, coolant temperature sensors may be arranged to sense coolant temperature at a coolant entrance and coolant exit of the engine and a radiator exit. According to the coolant temperatures sensed by the coolant temperature sensor, the valve opening degree of the coolant control valve unit may be controlled.

Recently, research has been conducted on a method which minimizes the number of coolant temperature sensors, senses coolant temperature at a predetermined position using an existing coolant temperature sensor, calculates coolant temperature at a predetermined position, and rapidly changes the valve opening degree of the coolant control valve unit using the sensed coolant temperature and the calculated coolant temperature, when the target coolant temperature was changed.

The above information disclosed in this Background section is only for enhancement of understanding of the background of the disclosure and therefore it may contain information that does not form the prior art that is already known to a person of ordinary skill in the art.

Further areas of applicability will become apparent from the description provided herein. It should be understood that the description and specific examples are intended for purposes of illustration only and are not intended to limit the scope of the present disclosure.

SUMMARY

The present disclosure provides an engine cooling system having a coolant temperature sensor, which is capable of sensing a second coolant temperature at a coolant exit of an engine using one coolant temperature sensor, calculating a first coolant temperature at a coolant entrance of the engine through the second coolant temperature, calculating a third coolant temperature at a coolant exit of a radiator, and rapidly controlling a valve opening degree of a coolant control valve unit using the first, second, and third coolant temperatures.

One form of the present disclosure provides an engine cooling system having a coolant temperature sensor including: a second coolant temperature sensor disposed to sense the temperature of coolant discharged from an engine; a radiator radiating heat to the outside while a part of the coolant discharged from the engine is passed through the radiator; a coolant control valve unit disposed to control coolant passing through the radiator and coolant supplied from the engine; and a control unit configured to control the temperature of the coolant by controlling the coolant control valve unit according to the second coolant temperature sensed by the second coolant temperature sensor, wherein the control unit calculates a first coolant temperature at a coolant entrance of the engine using the second coolant temperature and a heat rejection rate of the engine, the heat rejection rate being calculated according to the operation condition, calculates a third coolant temperature of coolant discharged from the radiator according to heat radiation of the radiator, the heat radiation being calculated according to the operation condition, and controls the opening degree of the coolant control valve unit using the first, second, and, third coolant temperatures.

The radiator may be installed on a branch line which diverges from a coolant line in the downstream side of the second coolant temperature sensor, and the heated coolant discharged from the engine and the cooled coolant discharged from the radiator may join each other in the coolant control valve unit and circulate toward the entrance of the engine.

The control unit may calculate a coolant entrance/exit temperature difference of the engine according to engine torque and engine RPM (revolutions per minute), and calculate the first coolant temperature using the coolant entrance/exit temperature difference and the second coolant temperature.

The control unit may correct the first coolant temperature according to the second coolant temperature, and apply the corrected first coolant temperature.

The control unit may calculate a flow rate of coolant passing through the radiator, according to the current valve opening degree of the coolant control valve unit and the RPM of the engine, calculate heat radiation of the radiator according to the calculated radiator coolant flow rate, vehicle speed and outdoor temperature, and calculate the third coolant temperature of coolant discharged from the radiator using the calculated heat radiation of the radiator and the second coolant temperature.

The engine cooling system may further include a coolant temperature sensor configured to correct the third coolant temperature according to the second coolant temperature, and apply the corrected third coolant temperature.

The valve opening degree α of the coolant control valve unit may be calculated through the following equation:

$$\text{valve opening degree } \alpha=(B0*(T2-T1))/(A1*(T1-T3)-(B1-B0)*(T2-T1)),$$

where B0 represents an engine coolant flow rate in a state where the opening degree of the valve at the radiator coolant path is 0, T2 represents the second coolant temperature, T1 represents the first coolant temperature, A1 represents a radiator coolant flow rate in a state where the coolant path at the radiator is completely opened by the valve, T3 represents the third coolant temperature, and B1 represents an engine coolant flow rate in a state where the coolant path at the radiator is completely opened by the valve.

The control unit may calculate the first coolant temperature using the following equation:

$$Q=M*Cp*(T2-T1),$$

where Q represents an engine heat rejection rate, M represents an engine coolant flow rate, Cp represents a coolant specific heat, T2 represents the second coolant temperature (sensed value or target value), and T1 represents the first coolant temperature (calculated value).

The control unit may calculate a new target coolant temperature according to the operation condition, and when it is determined that a difference between the previous target coolant temperature and the calculated new target coolant temperature exceeded a predetermined value, the control unit may calculate the valve opening degree of the coolant control valve unit using the first, second, and third coolant temperatures, and jumping-control the coolant control valve unit to reach the calculated valve opening degree.

The control unit may jumping-control the coolant control valve unit to reach the calculated valve opening degree, and control the valve through Proportional-Integral (PI) control, Proportional-Integral-Derivative (PID) control or predetermined map data according to the operation condition.

The flow rate of coolant passing through the engine may be selected from map data corresponding to the RPM of the engine.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 4A is an equation showing a method for calculating an opening degree of the valve in the engine cooling system according to one form of the present disclosure;

FIG. 4B is an equation obtained by simplifying the equation of FIG. 4A;

Figure 1:
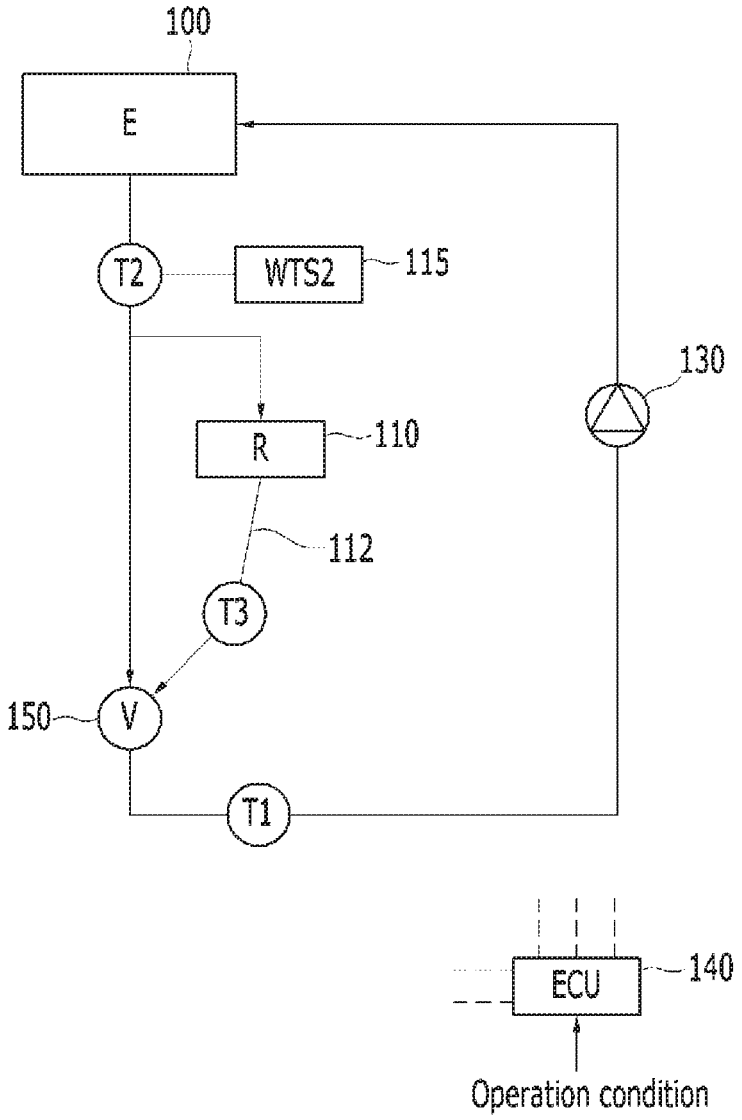
FIG. 1 is a schematic configuration diagram of an engine cooling system having a coolant temperature sensor according to one form of the present disclosure.

The drawings described herein are for illustration purposes only and are not intended to limit the scope of the present disclosure in any way.

DESCRIPTION OF SYMBOLS

| | |
|---|---|
| 100: | Engine |
| 110: | Radiator |
| 112: | Branch line |
| 115: | Second coolant temperature sensor |
| 130: | Coolant pump |
| 140: | Control unit |
| 150: | Coolant control valve unit |
| 200: | Rotary valve |
| 205: | Coolant path |

DETAILED DESCRIPTION

The following description is merely exemplary in nature and is not intended to limit the present disclosure, application, or uses. It should be understood that throughout the drawings, corresponding reference numerals indicate like or corresponding parts and features.

In addition, the size and thickness of each configuration shown in the drawings are arbitrarily shown for understanding and ease of description, but the present disclosure is not limited thereto, but the thicknesses of the components are expanded to clarify a plurality of parts and regions.

In order to clearly describe the forms of the present disclosure, parts having no relation to description will be omitted. Throughout the entire specification, like reference numerals designate like elements throughout the specification.

In the following descriptions, terms such as first and second are used to distinguish elements from each other because the elements have the same name, and the order of the terms is not limited thereto.

FIG. 1 is a schematic configuration diagram of an engine cooling system having a coolant temperature sensor according to one form of the present disclosure.

Referring to FIG. 1, the engine cooling system includes an engine 100, a second coolant temperature sensor 115, a radiator 110, a coolant control valve unit 150, a coolant pump 130 and a control unit 140.

Coolant is pumped by the coolant pump 130 and circulates through the engine 100 and the coolant control valve unit 150, and the radiator 110 cools a part of the coolant discharged from the engine 100.

The radiator 110 may be installed on a branch line 112 which diverges from a coolant line at the coolant exit of the engine 100 and joins the coolant control valve unit 150, and the coolant control valve unit 150 may control coolant passing through the radiator 110 or control coolant supplied from the engine 100, thereby controlling the entire temperature of the coolant.

That is, the coolant control valve unit 150 may control the entire temperature of the coolant by adjusting the mixing ratio of the heated coolant discharged from the engine 100 and the cooled coolant passing through the radiator 110.

The second coolant temperature sensor 115 directly senses a second coolant temperature T2 of the coolant discharged from the engine 100, and transmits the second coolant temperature T2 to the control unit 140.

The control unit 140 can calculate a third coolant temperature T3 of the cooled coolant discharged from the radiator 110 and a first coolant temperature T1 of coolant which is mixed in the coolant control valve unit 150 and introduced into the engine 100, using an operation condition, previous stored data and the second coolant temperature T2.

In one form of the present disclosure, the control unit 140 may control the valve opening degree of the coolant control valve unit 150 using the calculated first and third coolant temperatures T1 and T3 and the sensed second coolant temperature T2, calculate the first and third coolant temperatures T1 and T3 according to the target coolant temperature (for example, T2), and control the valve opening degree of the coolant control valve unit 150.

The opening degree of the coolant control valve unit 150 may indicate the opening degree of the coolant path connected to the exit of the radiator 110. When the opening degree is increased, the amount of coolant passing through the radiator 110 increases, but the amount of coolant passing through the engine 100 decreases.

The control unit 140 may include one or more microprocessors operated by a predetermined program, and the predetermined program may include a series of commands for executing a method according to one form of the present disclosure, which will be described below.

Figure 2:
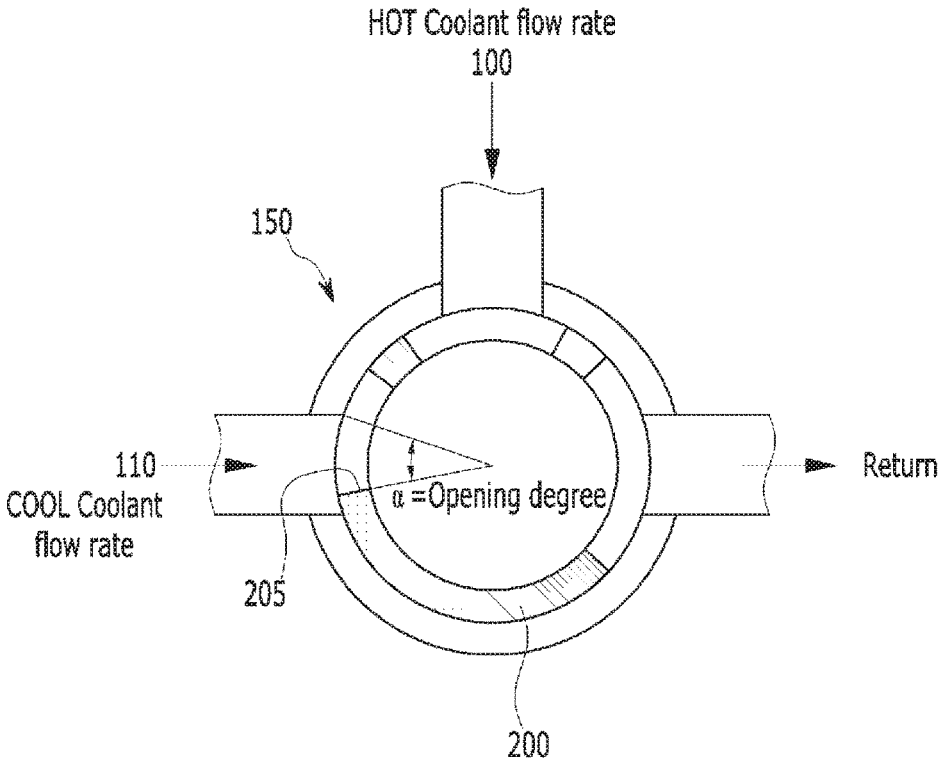
FIG. 2 is a schematic cross-sectional view of a coolant control valve unit in the engine cooling system according to one form of the present disclosure.

FIG. 2 is a schematic cross-sectional view of the coolant control valve unit in the engine cooling system according to one form of the present disclosure.

Referring to FIG. 2, the coolant control valve unit 150 includes a rotary valve 200 having coolant paths 205 formed therein, and one of the coolant paths 205 is connected to the exit of the radiator 110.

The rotary valve 200 is rotated by a motor driving unit (not illustrated) of the coolant control valve unit 150, and the rotational position of the rotary valve 200 is controlled by the control unit 140 and sensed according to the rotational position of the motor.

In one form of the present disclosure, the opening degree $\alpha$ of the coolant path 205 connected to the exit of the radiator 110 is controlled according to the rotational position of the rotary valve 200.

Figure 3:
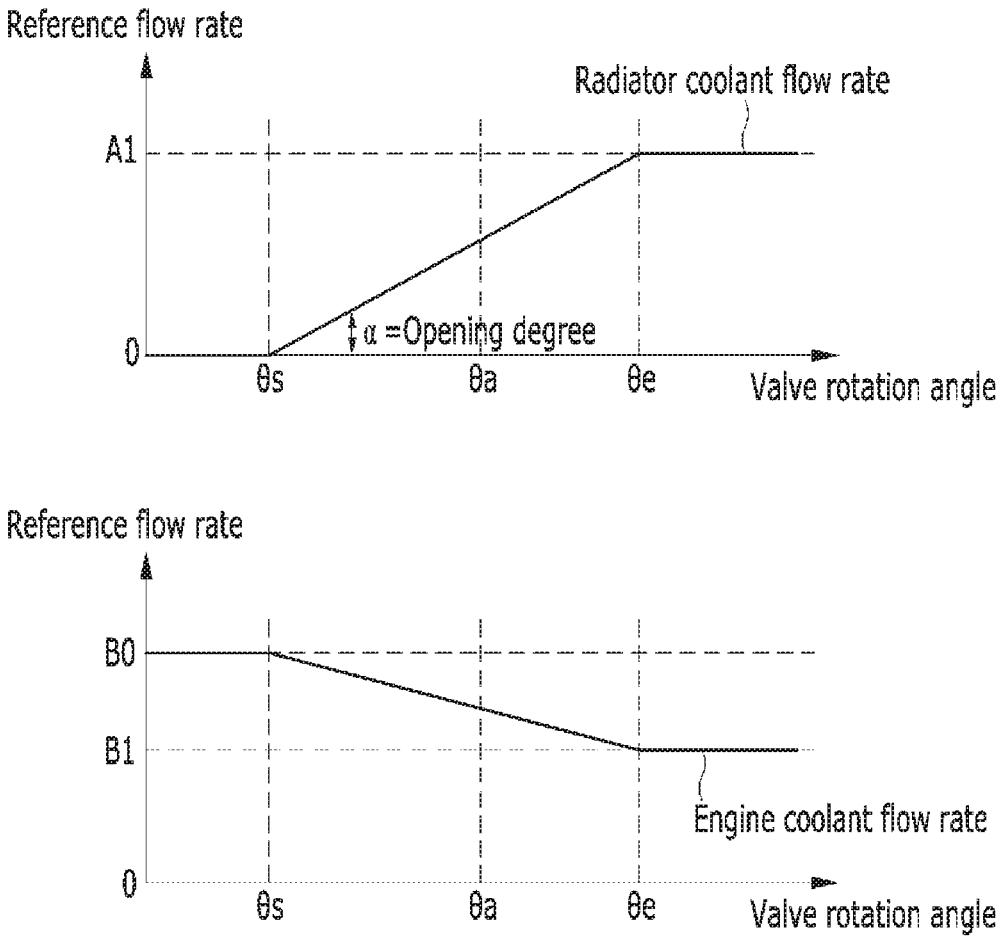
FIG. 3 is a graph illustrating coolant flow rates of an engine and a radiator based on an opening degree of a valve in the engine cooling system according to one form of the present disclosure.

FIG. 3 is a graph illustrating the coolant flow rates of the engine and the radiator based on the opening degree of the valve in the engine cooling system according to one form of the present disclosure.

Referring to FIG. 3, the horizontal axis indicates the rotation angle of the rotary valve 200 (hereafter, referred to as the valve), and the vertical axis indicates a reference flow rate of coolant passing through the radiator 110 and a reference flow rate of coolant flowing from the engine 100 toward the coolant control valve unit 150.

The reference flow rate is a predetermined constant, and converted into the flow rate of coolant discharged from the radiator 110 or the flow rate of coolant flowing from the engine 100 to the coolant control valve unit 150, according to the RPM of the engine 100 or the coolant pump 130. In one form of the present disclosure, the entire coolant flow rate may be varied according to the RPM of the engine 100.

When the rotation angle of the valve 200 reaches a first point $\theta s$, the flow rate of coolant passing through the radiator 110 is 0, and the flow rate of coolant flowing from the engine 100 to the coolant control valve unit 150 is B0.

When the rotation angle of the valve 200 reaches a second point $\theta e$, the flow rate of coolant passing through the radiator 110 is A1 and the flow rate of coolant flowing from the engine 100 to the coolant control valve unit 150 is B1.

Furthermore, when the rotation angle of the valve 200 reaches a third point $\theta a$ between the first point and the second point, the flow rate of coolant discharged from the radiator 110 is increasing, and the flow rate of coolant flowing from the engine 100 to the coolant control valve unit 150 is decreasing.

FIG. 4A is an equation showing a method for calculating an opening degree of the valve in the engine cooling system according to one form of the present disclosure.

In the equation of FIG. 4A, Cp2 represents the specific heat of coolant flowing from the engine 100 to the coolant control valve unit 150, Cp1 represents the specific heat of coolant passing through the coolant entrance of the engine 100, and Cp3 represents the specific heat of coolant discharged from the radiator 110.

T2 represents a value sensed by the second coolant temperature sensor 115, T1 and T3 represent values calculated by the control unit 140, and B0, A1 and B1 represent values which are selected according to the opening degree of the valve 200 in FIG. 3.

The detailed descriptions of a method for inducing the equation for calculating the opening degree $\alpha$ of the valve in FIG. 4A are omitted herein.

FIG. 4B is an equation obtained by simplifying the equation of FIG. 4A.

When the specific heats Cp1, Cp2 and Cp3 are considered as one specific heat constant and removed from the numerator and denominator in the equation of FIG. 4A, the equation of FIG. 4B is induced. As shown in FIG. 4B, when A1, B1 and B0 are selected from map data, T2 (second coolant temperature) is sensed from the second coolant temperature sensor 115, and T1 and T3 (first and third coolant temperatures) are calculated, the opening degree α of the valve 200 can be acquired.

Figure 5:
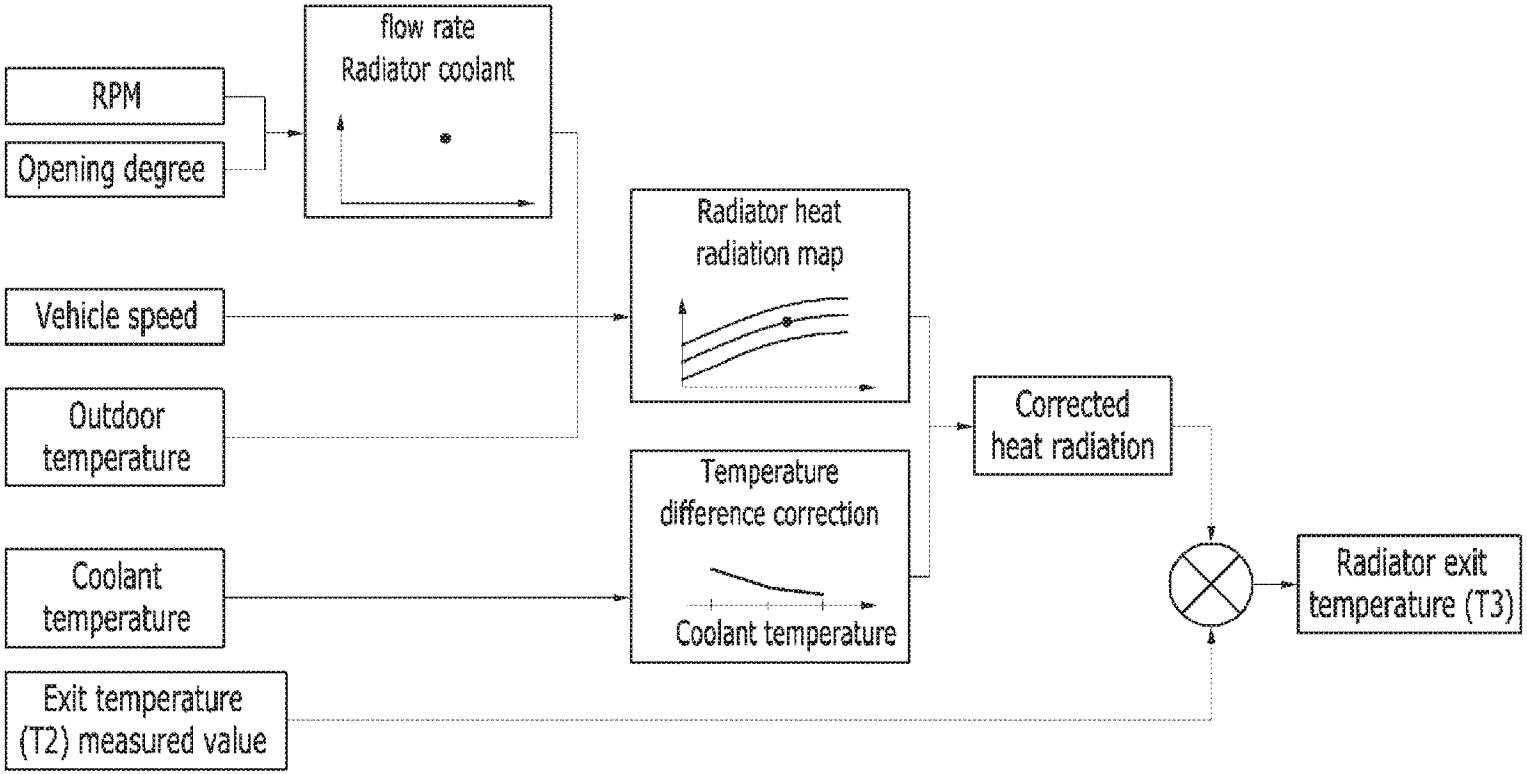
FIG. 5 is a diagram illustrating a method for calculating a third coolant temperature T3 based on the flow rate of coolant passing through a radiator in the engine cooling system according to one form of the present disclosure.

FIG. 5 is a diagram illustrating a method for calculating the third coolant temperature T3 based on the flow rate of coolant passing through the radiator in the engine cooling system according to one form of the present disclosure.

Referring to FIG. 5, the RPM of the engine 100 and the current opening degree of the valve 200 may be used to select the flow rate of coolant passing through the radiator 110, and heat radiation of the radiator 110 may be calculated through the speed and outdoor temperature of the vehicle and then corrected through the current coolant temperature (for example, T2).

Accordingly, the exit temperature of the radiator 110 or the third coolant temperature T3 may be calculated through the second coolant temperature T2 and the corrected heat radiation.

Figure 6:
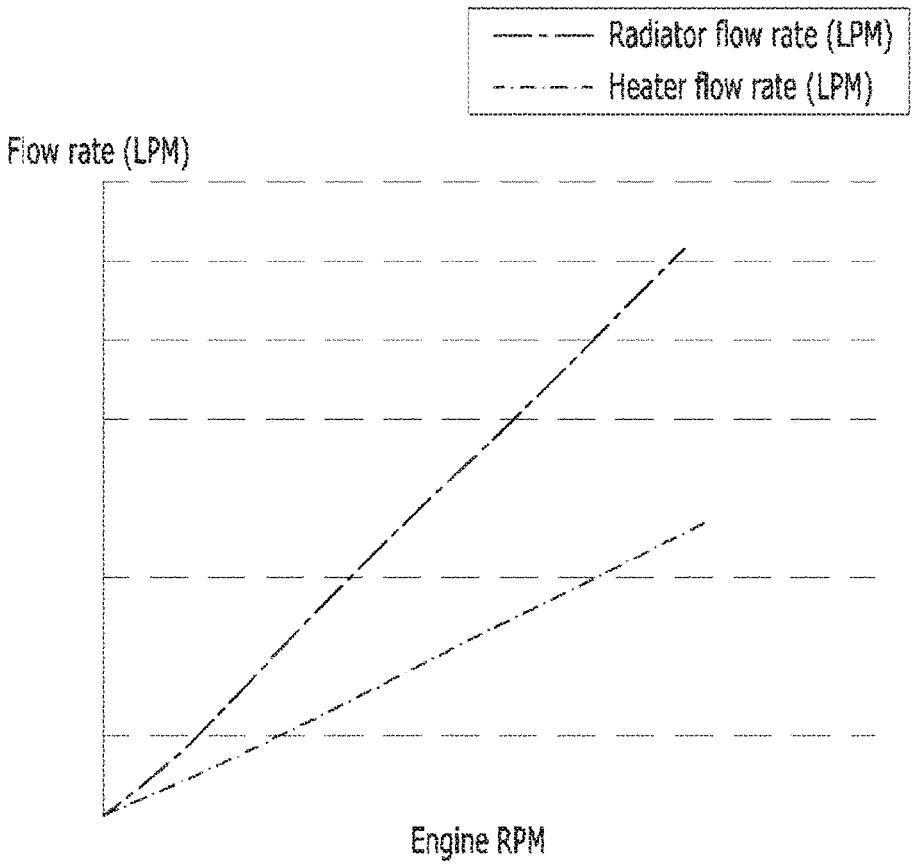
FIG. 6 is a graph illustrating a coolant flow rate based on engine RPM in the engine cooling system according to one form of the present disclosure.

FIG. 6 is a graph illustrating a coolant flow rate based on engine RPM in the engine cooling system according to one form of the present disclosure.

Referring to FIG. 6, the horizontal axis indicates the RPM of the engine 100, and the vertical axis indicates the flow rate of coolant passing through the radiator 110 or heater (not illustrated). The coolant flow rate is stored in predetermined map data, according to the opening degree of the valve 200.

Figure 7:
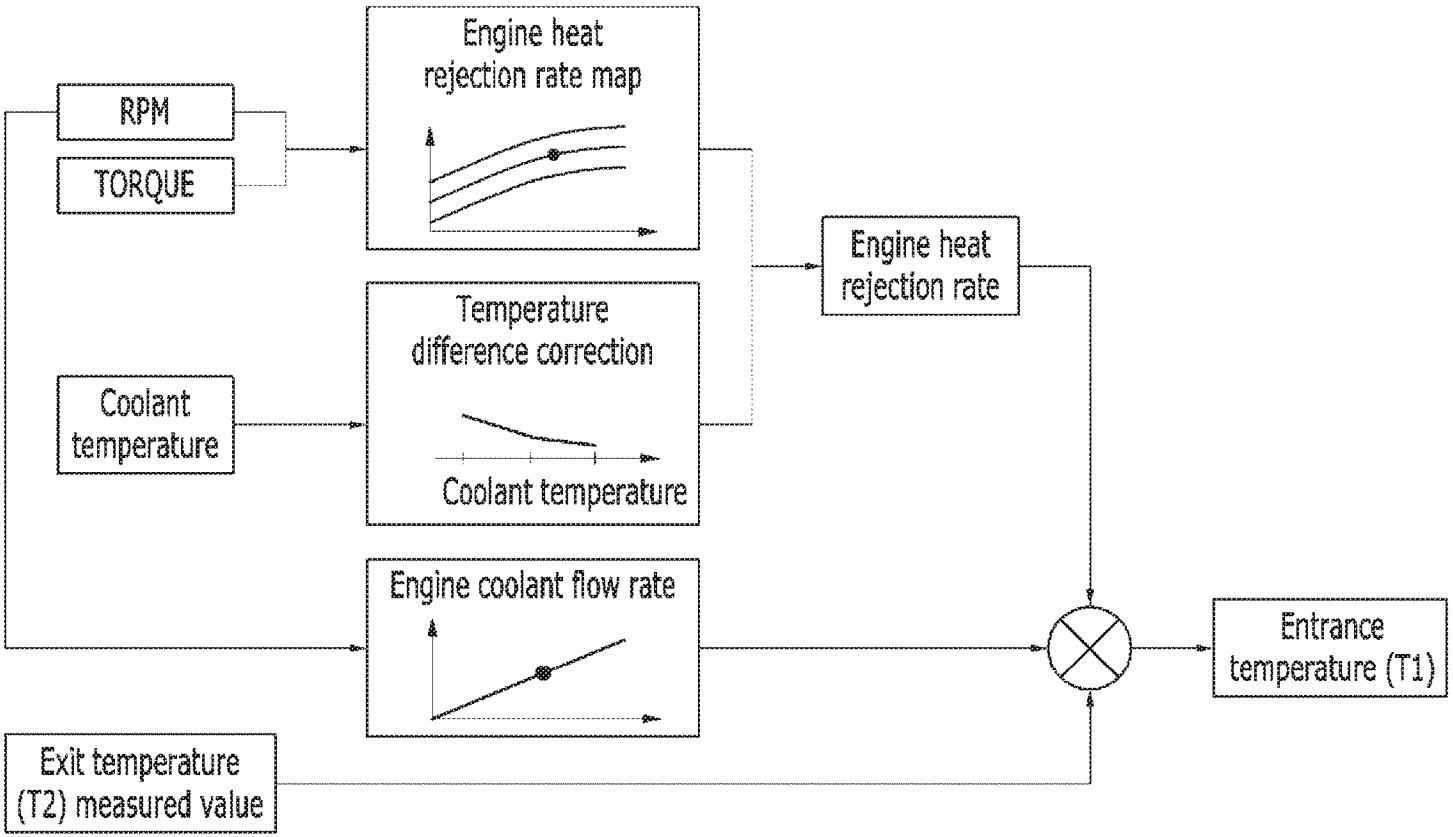
FIG. 7 is a diagram illustrating a method for calculating a first coolant temperature T1 based on an engine heat rejection rate in the engine cooling system according to one form of the present disclosure.

FIG. 7 is a diagram illustrating a method for calculating the first coolant temperature T1 based on an engine heat rejection rate in the engine cooling system according to one form of the present disclosure.

Referring to FIG. 7, an engine RPM and engine torque are used to select a heat rejection rate of the engine 100, a flow rate of coolant circulating through the engine 100 is calculated according to the engine RPM, and the coolant exit temperature T2 of the engine 100 is sensed.

In a heat balance equation, the heat rejection rate of the engine, the coolant exit temperature T2, the specific heat of coolant and the coolant flow rate may be used to calculate the coolant entrance temperature T1.

In one form of the present disclosure, the heat ejection rate of the engine may be corrected according to the coolant temperature (for example, T2), and the corrected heat rejection rate may be used.

Figure 8:
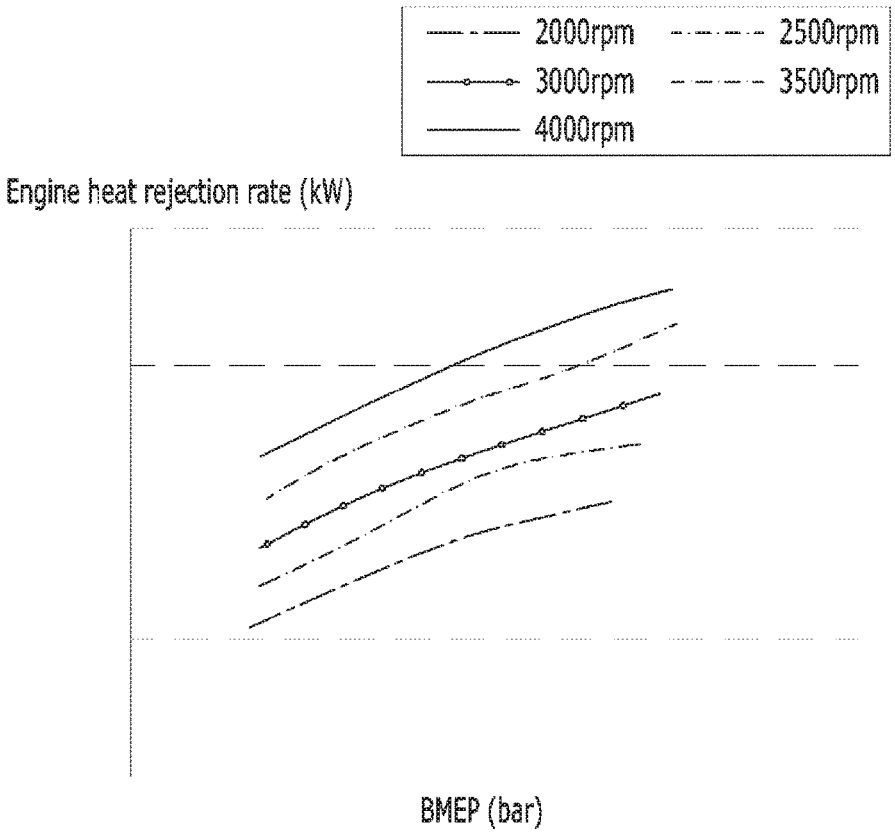
FIG. 8 is a graph illustrating engine heat rejection rates based on engine torque and engine RPM in the engine cooling system according to one form of the present disclosure.

FIG. 8 is a graph illustrating engine heat rejection rates based on engine torque and engine RPM in the engine cooling system according to one form of the present disclosure.

Referring to FIG. 8, the horizontal axis indicates torque (BMEP (Brake Mean Effective Pressure), and the vertical axis indicates engine heat rejection rates based on the RPM of the engine 100.

Such data may be stored in a memory and selectively used by the control unit 140.

Accordingly, the control unit 140 may select or calculate the heat rejection rate of the engine through the engine torque and PRM corresponding to the operation condition.

Figure 9:
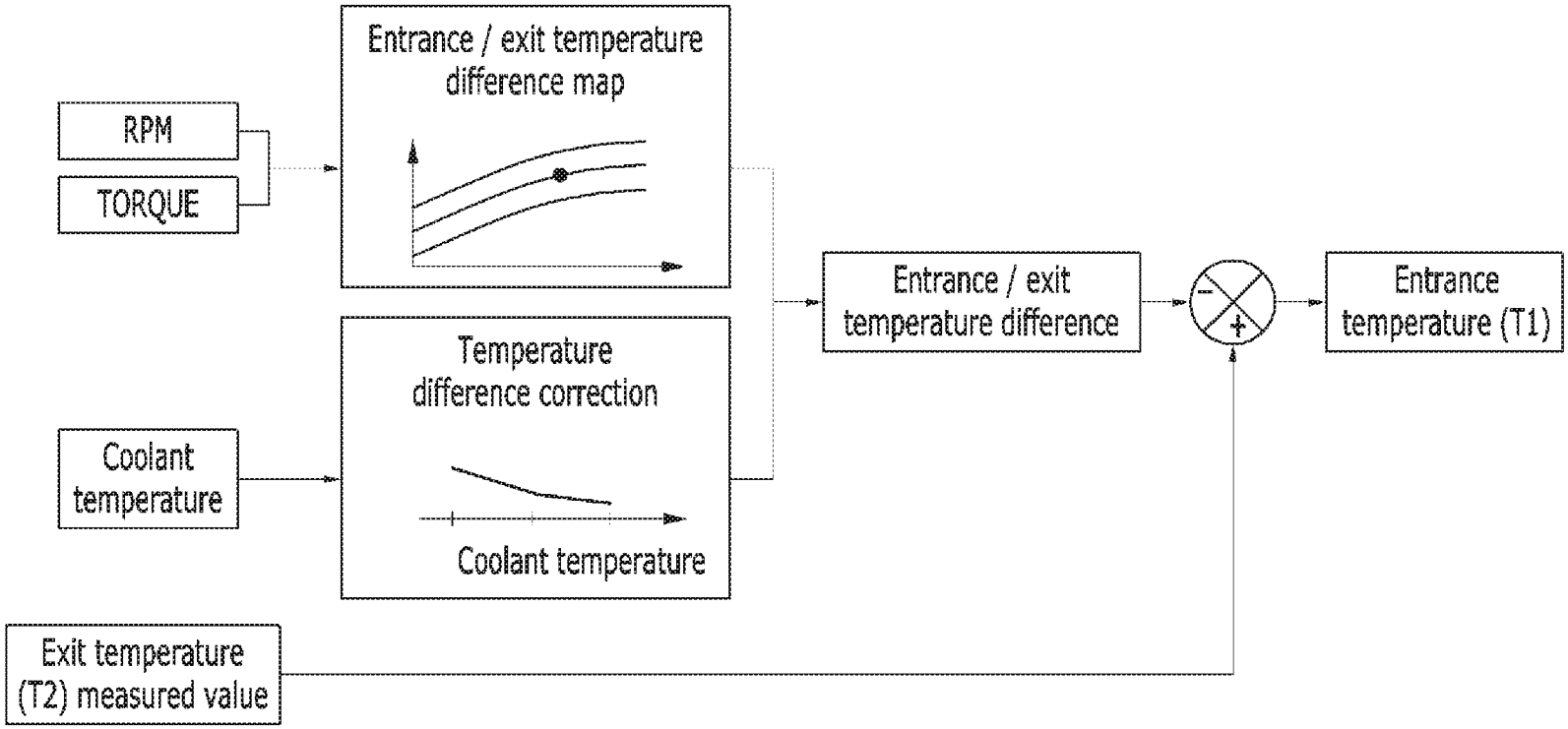
FIG. 9 is a diagram illustrating a method for calculating the first coolant temperature T1 according to engine RPM and torque in the engine cooling system according to one form of the present disclosure.

FIG. 9 is a diagram illustrating a method for calculating the first coolant temperature T1 according to the engine RPM and torque in the engine cooling system according to one form of the present disclosure.

Referring to FIG. 9, engine RPM and engine torque are used to select a temperature difference from a coolant entrance/exit temperature difference map, and a final entrance/exit temperature difference (T2−T1) is derived by correcting the temperature difference according to a coolant temperature (for example, T2).

Therefore, the final entrance/exit temperature difference (T2−T1) and the coolant temperature T2 sensed through the second coolant temperature sensor 115 may be used to calculate the engine coolant entrance temperature T1.

Figure 10:
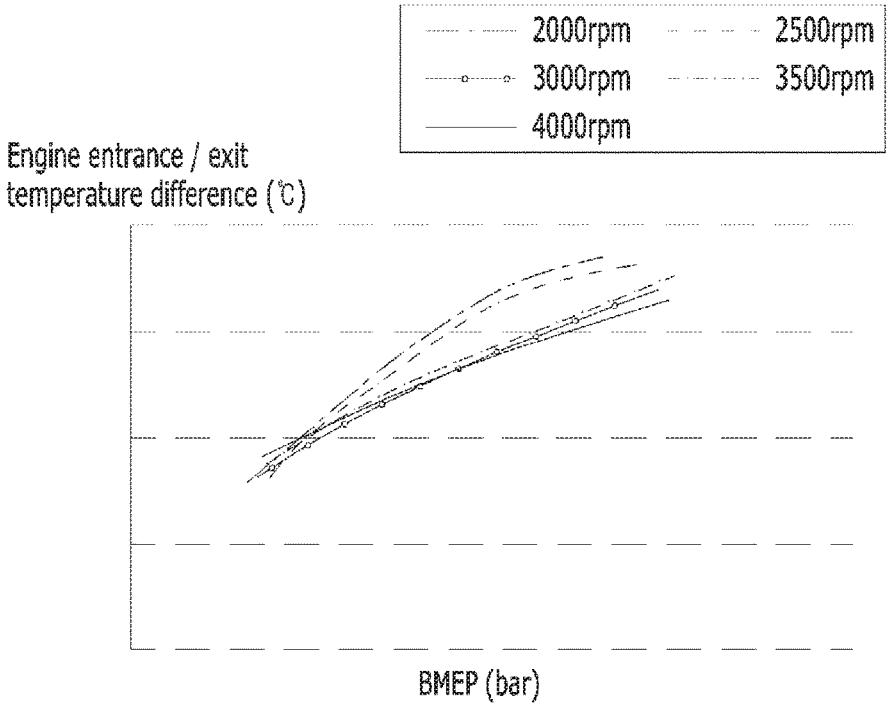
FIG. 10 is a graph illustrating a coolant entrance/exit temperature difference of the engine, which corresponds to engine torque and engine RPM, in the engine cooling system according to one form of the present disclosure.

FIG. 10 is a graph illustrating a coolant entrance/exit temperature difference of the engine, which corresponds to engine torque and engine RPM, in the engine cooling system according to one form of the present disclosure.

Referring to FIG. 10, the horizontal axis indicates BMEP which is used as the same meaning as engine torque, and the vertical axis indicates an engine entrance/exit temperature difference (T2−T1) based on engine RPM.

Such data may be stored in the memory, and the control unit 140 may select or calculate the engine entrance/exit coolant temperature difference according to the engine torque (or BMEP) and the engine RPM.

Figure 11:
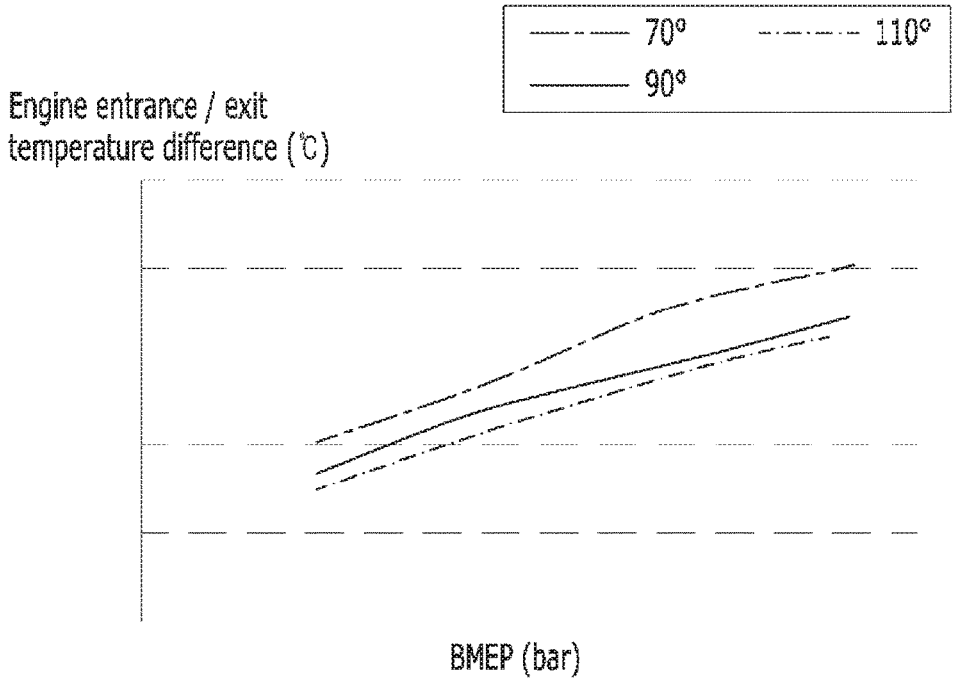
FIG. 11 is a graph illustrating an engine coolant entrance/exit temperature difference based on engine torque and the coolant temperature T2 in the engine cooling system according to one form of the present disclosure.

FIG. 11 is a graph illustrating an engine coolant entrance/exit temperature difference based on engine torque and the coolant temperature T2 in the engine cooling system according to the exemplary form of the present disclosure.

Referring to FIG. 11, the vertical axis indicates BMEP which is used as the same meaning as engine torque, and the vertical axis indicates an engine coolant entrance/exit temperature difference (T2−T1) based on a coolant temperature (for example, T2).

That is, according to coolant temperatures, engine coolant entrance/exit temperature differences are differently distributed. In FIG. 10, an entrance/exit temperature difference may be selected by the engine torque and RPM. The entrance/exit temperature difference may be corrected according to the coolant temperature of FIG. 11, and the corrected entrance/exit temperature difference may be used.

Figure 12:
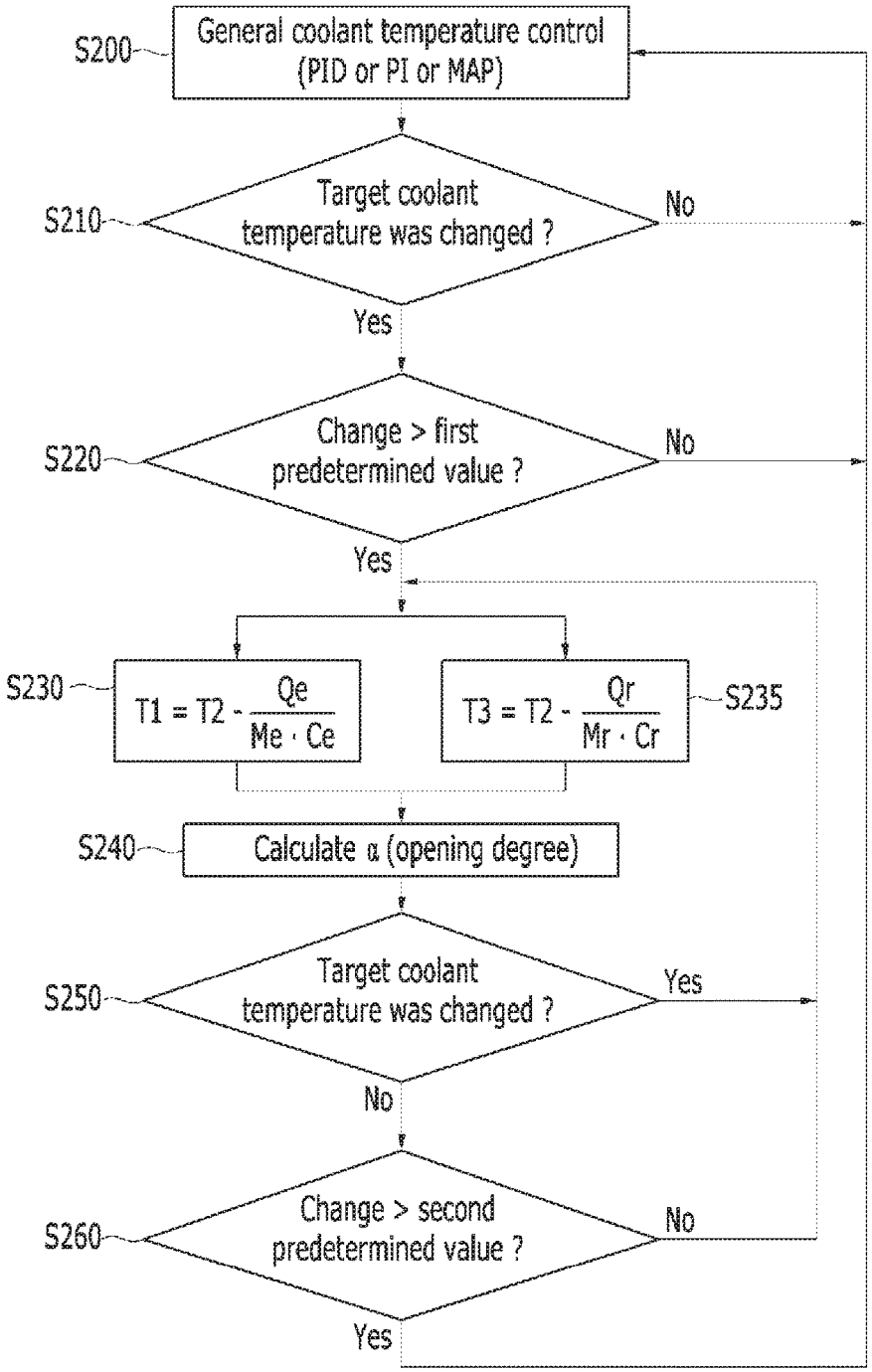
FIG. 12 is a flowchart showing a method for controlling coolant temperature in the engine cooling system according to one form of the present disclosure.

FIG. 12 is a flowchart showing a method for controlling coolant temperature in the engine cooling system according to one form of the present disclosure.

Referring to FIG. 12, general coolant temperature control is performed at step S200. The general coolant temperature control includes PID control, PI control or Map control.

At step S210, the control unit determines whether the target coolant temperature is changed. The target coolant temperature may be set to T2. When it is determined that the target coolant temperature was not changed, step S200 is performed, and when it is determined that the target coolant temperature was changed, step S220 is performed.

At step S220, the control unit determines whether the change of the target coolant temperature or a difference between the previous target coolant temperature and the new target coolant temperature is larger than a first predetermined value.

When the change of the target coolant temperature is equal to or smaller than the first predetermined value, step S200 is performed, and when the change is larger than the first predetermined value, steps 3230 and 3235 are performed.

At step S230, the second coolant temperature T2, the engine heat rejection rate Qe, the engine coolant flow rate Me and the specific heat Ce (constant) are used to calculate the engine coolant entrance temperature T1.

At step S235, the second coolant temperature T2, radiator heat radiation Qr, a radiator coolant flow rate Mr and specific heat Cr (constant) are used to calculate the radiator coolant exit temperature T3.

At step S240, the temperatures T1 to T3 are used to calculate the target opening degree of the valve 200 based on the equation of FIG. 4B, and the control unit 140 jumping-controls the valve opening degree of the coolant control valve unit 150 according to the target opening degree.

At step S250, the control unit determines whether the target coolant temperature was changed. At step S260, the control unit determines whether the change (the difference between the previous target coolant temperature and the new target coolant temperature) is larger than a second predetermined value, and performs step S200 or steps S230 and S235.

Figure 13:
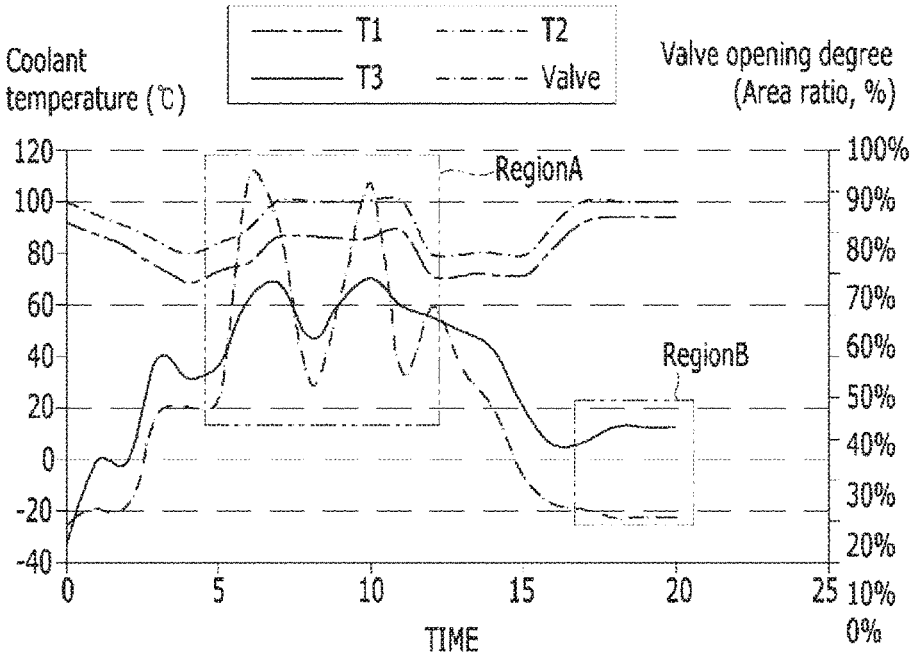
FIG. 13 is a graph illustrating a valve opening degree and coolant temperature which are changed with time, in the engine cooling system according to one form of the present disclosure.

FIG. 13 is a graph illustrating the valve opening degree and coolant temperature which are changed with time, in the engine cooling system according to one form of the present disclosure.

Referring to FIG. 13, the horizontal axis represents time, and the vertical axis represents a coolant temperature (for example, T2) and a valve opening degree.

T2 may represent the coolant exit temperature of the engine 100, T1 may represent the coolant entrance temperature of the engine 100, and T3 may represent the coolant exit temperature of the radiator 110. Furthermore, Valve may represent the opening degree of the coolant path 205 connected to the radiator 110 in the valve 200.

A region A is where the control unit jumping-controls the opening degree of the valve 200 because the target coolant temperature is changed. Since the opening degree is rapidly increased or decreased, the speed and reactivity of the control may be improved.

On the other hand, a region B is where the target coolant is not changed or changed within a predetermined area. In the region B, PI control, PID control or Map control may be performed while the opening degree of the valve 200 is slightly changed.

As such, one coolant temperature sensor may be used to sense the second coolant temperature at the coolant exit of the engine, the operation condition and the engine heat rejection rate may be used to calculate the first coolant temperature at the coolant entrance of the engine, and the operation condition and the radiator heat radiation may be used to calculate the third coolant temperature at the coolant exit of the radiator.

Furthermore, the calculated first and third coolant temperatures and the sensed second coolant temperature may be used to derive the valve opening degree of the coolant control valve unit, and the coolant control valve unit may be rapidly controlled through the derived valve opening, thereby improving the reactivity and controllability of the coolant control.

Furthermore, as one coolant temperature sensor is used, the part cost and the design cost can be reduced.

While this disclosure has been described in connection with what is presently considered to be practical forms, it is to be understood that the disclosure is not limited to the disclosed forms, but, on the contrary, is intended to cover various modifications and equivalent arrangements included within the spirit and scope of the present disclosure.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. An engine cooling system having a coolant temperature sensor disposed in the engine cooling system to sense a second coolant temperature, the sensed second coolant temperature corresponding to a coolant discharged from an engine, and wherein the engine cooling system comprises:

a radiator radiating heat when a portion of the coolant discharged from the engine is passed through the radiator;

a coolant control valve unit disposed in the engine cooling system to control a flow of the coolant passed through the radiator and a flow of the coolant discharged from the engine; and a control unit programmed to control the coolant control valve unit according to an operation condition of the engine and the sensed second coolant temperature, wherein the control unit calculates:

a first coolant temperature corresponding to a coolant entrance of the engine using the sensed second coolant temperature and a heat rejection rate of the engine, the heat rejection rate of the engine being a first function of the operation condition of the engine;

a third coolant temperature corresponding to a coolant exit of the radiator and the heat radiated from the radiator, the heat radiated from the radiator being a second function of the operation condition of the engine; and a valve opening degree of the coolant control valve unit, the calculated valve opening degree being based on each of the sensed second coolant temperature, the calculated first coolant temperature, and the calculated third coolant temperature; and wherein the control unit executes a feed-forward control of the coolant control valve unit in order to reach the calculated valve opening degree.

2. The engine cooling system of claim 1, wherein:

the radiator is installed in a branch coolant line which diverges from a main coolant line on a downstream side of the coolant temperature sensor, and the coolant discharged from the engine joins the coolant passed through the radiator in the coolant control valve unit and circulates toward the coolant entrance of the engine.

3. The engine cooling system of claim 1, wherein:

the control unit calculates an engine coolant entrance/exit temperature difference according to engine torque and engine revolutions per minute (RPM), and calculates the first coolant temperature using the engine coolant entrance/exit temperature difference and the sensed second coolant temperature.

4. The engine cooling system of claim 3, wherein:

the control unit corrects the calculated first coolant temperature according to the sensed second coolant temperature.

5. The engine cooling system of claim 3, wherein:

the control unit calculates a radiator coolant flow rate according to a current valve opening degree of the coolant control valve unit and engine revolutions per minute (RPM), calculates the heat radiated from the radiator using the calculated radiator coolant flow rate, a vehicle speed, and an outdoor temperature, and calculates the third coolant temperature using the calculated heat radiated from the radiator and the sensed second coolant temperature.

6. The engine cooling system of claim 5, wherein:

the control unit is further configured to correct the calculated third coolant temperature according to the sensed second coolant temperature.

7. The engine cooling system of claim 1, wherein:

a valve opening degree α of the coolant control valve unit is calculated through the following equation:

$$\text{valve opening degree } \alpha=(B0*(T2-T1))/(A1*(T1-T3)-(B1-B0)*(T2-T1)),$$

where

B0 represents an engine coolant flow rate when there is no flow of coolant being passed through the coolant control valve unit from the radiator, T2 represents the sensed second coolant temperature, T1 represents the calculated first coolant temperature, A1 represents a radiator coolant flow rate when there is a maximum flow of coolant being passed through the coolant control valve unit from the radiator, T3 represents the calculated third coolant temperature, and B1 represents the engine coolant flow rate when there is a maximum flow of coolant being passed through the coolant control valve unit from the radiator.

8. The engine cooling system of claim 1, wherein:

the control unit calculates the first coolant temperature using the following equation:

$$Q=M*Cp*(T2-T1),$$

where

Q represents the heat rejection rate of the engine,

M represents an engine coolant flow rate,

Cp represents a coolant specific heat,

T2 represents the sensed second coolant temperature, and

T1 represents the calculated first coolant temperature.

9. The engine cooling system of claim 1, wherein:

the feed-forward control of the coolant control valve unit is achieved through at least one of Proportional-Integral (PI) control, Proportional-Integral-Derivative (PID) control, and predetermined map data according to the operation condition of the engine.

10. The engine cooling system of claim 8, wherein:

the engine coolant flow rate is determined using map data corresponding to engine revolutions per minute (RPM).

* * * * *